US011383525B2

(12) United States Patent
Praharaj et al.

(10) Patent No.: US 11,383,525 B2
(45) Date of Patent: Jul. 12, 2022

(54) SYSTEM AND METHOD FOR EFFICIENTLY PURGING PRINTHEADS

(71) Applicant: Xerox Corporation, Norwalk, CT (US)

(72) Inventors: Seemit Praharaj, Webster, NY (US); Paul J. McConville, Webster, NY (US); Jason M. LeFevre, Penfield, NY (US); Michael J. Levy, Webster, NY (US); Thomas J. Wyble, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 157 days.

(21) Appl. No.: 16/897,941

(22) Filed: Jun. 10, 2020

(65) Prior Publication Data

US 2021/0387459 A1 Dec. 16, 2021

(51) Int. Cl.
*B41J 2/175* (2006.01)
*B41J 2/165* (2006.01)

(52) U.S. Cl.
CPC ..... *B41J 2/17596* (2013.01); *B41J 2/16535* (2013.01)

(58) Field of Classification Search
CPC .... B41J 2/175; B41J 2/17596; B41J 2/17509; B41J 2/17566; B41J 2/17556; B41J 29/38; B41J 2/17523; B41J 2/16535
See application file for complete search history.

(56) References Cited

U.S. PATENT DOCUMENTS 4,296,418 A 10/1981 Yamazaki et al.
4,364,065 A 12/1982 Yamamori et al.
4,947,187 A 8/1990 Iwagami
5,394,178 A 2/1995 Grange
5,635,965 A 6/1997 Purwins et al.
5,936,647 A 8/1999 Rhodes et al.
5,980,622 A 11/1999 Byers
7,156,514 B2 1/2007 Rosa
7,753,475 B2 7/2010 Berry et al.
7,992,986 B2 8/2011 Snyder
8,592,503 B2 11/2013 Bogale et al.
(Continued)

FOREIGN PATENT DOCUMENTS

EP 1 827 839 B1 2/2009
KR 10-1397307 B1 5/2014
(Continued)

OTHER PUBLICATIONS

Kwon et al.; Measurement of inkjet first-drop behavior using a high-speed camera; Review of Scientific Instruments; Mar. 2, 2016; vol. 87—Issue No. 3; AIP Publishing.

*Primary Examiner* — Jannelle M Lebron
(74) *Attorney, Agent, or Firm* — Maginot Moore Beck LLP

(57) ABSTRACT

A purge cycle is performed with an ink delivery system of an inkjet printer by applying a pressure pulse to a printhead in the printer that is substantially shorter than pressure pulses previously used. A pressure at a predetermined threshold is generated behind a valve and then release to the printhead. The duration of the pressure application is in a range of about 150 milliseconds to about 250 milliseconds. This pressure pulse substantially reduces the amount of ink emitted during the purge. A bidirectional wipe of the printhead face is effective for restoring inkjets in the printhead even though the amount of emitted ink is substantially reduced.

16 Claims, 11 Drawing Sheets

(56) References Cited

U.S. PATENT DOCUMENTS

| | | | |
|---|---|---|---|
| 2002/0171705 | A1 | 11/2002 | Rhoads et al. |
| 2003/0231222 | A1 | 12/2003 | Jefferson et al. |
| 2006/0197792 | A1 | 9/2006 | Brown et al. |
| 2008/0204501 | A1 | 8/2008 | Kurita et al. |
| 2009/0231378 | A1 | 9/2009 | Snyder et al. |
| 2009/0237424 | A1 | 9/2009 | Martin et al. |
| 2010/0073445 | A1 | 3/2010 | Silverbrook et al. |
| 2013/0215189 | A1 | 8/2013 | Justice et al. |
| 2013/0300800 | A1 | 11/2013 | Ahl et al. |
| 2015/0002579 | A1 | 1/2015 | Inui |
| 2016/0185121 | A1 | 6/2016 | Somete |
| 2016/0339710 | A1 | 11/2016 | Sato et al. |
| 2019/0337298 | A1* | 11/2019 | Glassman ..... B41J 2/17596 |

FOREIGN PATENT DOCUMENTS

| | | | |
|---|---|---|---|
| WO | 1989004255 | A1 | 5/1989 |
| WO | 2008-026417 | A1 | 3/2008 |

* cited by examiner

SYSTEM AND METHOD FOR EFFICIENTLY PURGING PRINTHEADS

TECHNICAL FIELD

This disclosure relates generally to devices that produce ink images on media, and more particularly, to devices having printheads with inkjets that form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

A prior art ink delivery system 20 used in inkjet imaging devices is shown in FIG. 9. The ink delivery system 20 includes an ink supply reservoir 604 that is connected to a printhead 608 and is positioned below the printhead so the ink level can be maintained at a predetermined distance D below the printhead to provide an adequate back pressure on the ink in the printhead. This back pressure helps ensure good ink drop ejecting performance. The ink reservoir is operatively connected to a source of ink (not shown) that keeps the ink at a level that maintains the distance D. The printhead 608 has a manifold that stores ink until an inkjet pulls ink from the manifold. The capacity of the printhead manifold is typically five times the capacity of all of the inkjets. The inlet of the manifold is connected to the ink reservoir 604 through a conduit 618 and a conduit 634 connects the outlet of the manifold to a waste ink tank 638. A valve 642 is installed in the conduit 634 to selectively block the conduit 634. A valve 612 is also provided in the conduit 614 connecting an air pressure pump 616 to the ink reservoir 604 and this valve remains open except during purging operations.

In previously known inkjet imaging devices, some of the inkjets in the printheads begin to fail or operate unreliably after some period of use. A purge of the printheads is performed from time to time to restore the operational status of the inkjets. As used in this document, the term "purge" means the application of a predetermined pneumatic pressure to a printhead to force ink from the manifold of the printhead into and through the inkjets so ink containing debris or partially dried ink can flow onto the faceplate of the printhead. In the system of FIG. 9, the controller 80 operates pump 616 to build the pressure in ink reservoir 604 to a predetermined pressure that is adequate to purge the inkjets in the printhead 608 while the controller keeps the valve 612 closed to the atmosphere. The controller 80 monitors the signal generated by the pressure sensor 620 to determine when the predetermined pressure is reached. At that time, the controller stops the operation of pump 616 and the controller commences a timer. Thus, the pressure at the printhead builds quickly until the predetermined pressure is reached and then the pressure drops slowly as the ink seeps out of the inkjets in the printhead. A graph of this pressure cycle is shown in FIG. 10. When the timer reaches a predetermined time empirically determined as being sufficient for restoring inkjets in the printhead, the controller operates the valve 612 to open the conduit 614 to atmosphere so the pressure in the printhead 608 returns to being slightly negative due to gravity acting on the ink in the reservoir 604, which is physically lower than the printhead faceplate. As one can see if the graph of FIG. 10, the purge cycle is at least 2.5 seconds and that is a nominal time for known purge cycles.

One issue that arises from printhead purges is the loss of ink that is not used for printing. ink discharge to sufficiently flood the faceplate with ink, followed by a wipe. Typical ink mass ejected from a single printhead during a single purge cycle ranges from 5-10 grams. Since printhead maintenance is typically required at the beginning of a printing shift as well as the end of the printing shift with an intermittent frequency of once every two hours of operation. In operations requiring precise printing, the frequency of intra-operational purges may be higher to restore inoperable jets and to prevent inkjets from becoming inoperable. In some printing facilities, the total amount of ink lost to purging during a typical 8 hour shift is approximately 1200 grams. This amount is about 10% of the ink used for printing during the same time period. Reducing the amount of ink lost during printhead purging would be beneficial.

SUMMARY

A method of inkjet printer operation purges printheads in the printer in a manner that reduces ink lost during purging. The method includes operating a valve with a controller to close a conduit between the valve and a pump, operating the pump with the controller to build a pressure in the conduit, monitoring with the controller a signal from a pressure sensor operatively connected to the conduit between the valve and the pump, determining with the controller when the pressure in the conduit reaches a predetermined threshold, operating the valve with the controller to apply the pressure in the conduit to an ink reservoir and a printhead when the signal from the pressure sensor indicates the pressure within the conduit reaches the predetermined level, and operating the valve with the controller after a predetermined time has expired since the pressure was applied to vent the ink reservoir to atmosphere pressure.

An inkjet printer implements the method of operation that reduces the amount of ink lost during purging. The printer includes an inkjet printhead having a faceplate, an ink reservoir operatively connected to the printhead to provide ink from the ink reservoir to the printhead, a pump, a conduit operatively connected between the ink reservoir and the pump, a valve positioned in the conduit, the valve being configured to move to a first position where the conduit is vented to atmosphere pressure, to a second position where the pump builds pressure in the conduit between the valve and the pump, and a third position where the pressure between the valve and the pump is released to the ink reservoir and the printhead, a pressure sensor operatively connected to the conduit between the valve and the pump, the pressure sensor being configured to generate a signal indicative of a pressure within the conduit, and a controller operatively connected to the valve, the pressure sensor, and the pump. The controller is configured to move the valve to the second position and operate the pump to build pressure in the conduit, monitor the signal from the pressure sensor and determine when the pressure in the conduit reaches a predetermined threshold, move the valve to the third position to apply the pressure in the conduit to the ink reservoir and the printhead when the signal from the pressure sensor indicates the pressure within the conduit reaches the predetermined level, and to move the valve to the first position after a predetermined time has expired since moving the valve to the third position to vent the ink reservoir to atmosphere pressure.

BRIEF DESCRIPTION OF THE DRAWINGS

The foregoing aspects and other features of a system and method that reduce the amount of ink lost during purging are explained in the following description, taken in connection with the accompanying drawings.

DETAILED DESCRIPTION

Figure 1:
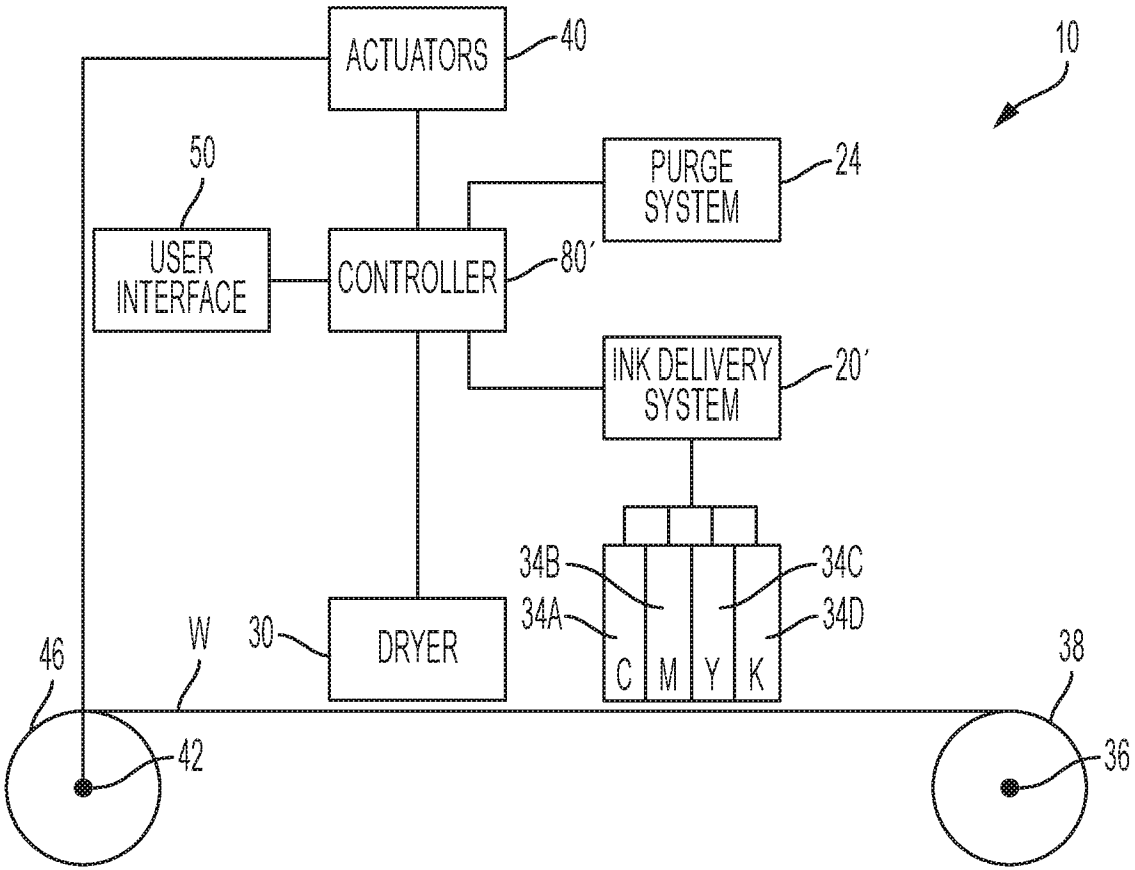
FIG. 1 is a schematic drawing of an inkjet printer that prints ink images directly to a web of media and that purges the printheads with a short duration purge pressure.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction along the surface of the image receiving surface. Also, the description presented below is directed to a system for purging inkjets in an inkjet printer in a manner that reduces the loss of ink during purging of the printheads. The reader should also appreciate that the principles set forth in this description are applicable to similar imaging devices that generate images with pixels of marking material.

FIG. 1 illustrates a high-speed ink image producing machine or printer 10 in which a controller 80' has been configured to perform the process 400 described below to operate the ink delivery system 20' (FIG. 2) to purge the inkjets in the printheads 34A, 34B, 34C, and 34D with a reduced loss of ink over previously known printers. As illustrated, the printer 10 is a printer that directly forms an ink image on a surface of a web W of media pulled through the printer 10 by the controller 80' operating one of the actuators 40 that is operatively connected to the shaft 42 about which a take up roll 46 is mounted. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that forms images on media wider than a single printhead. Additionally, the printheads can also be interlaced so the density of the drops ejected by the printheads in the cross-process direction can be greater than the smallest spacing between the inkjets in a printhead in the cross-process direction.

The aqueous ink delivery subsystem 20' has at least one ink reservoir containing one color of aqueous ink. Since the illustrated printer 10 is a multicolor image producing machine, the ink delivery system 20' includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules, as described with reference to the process 400 below, to attenuate the loss of ink from the printheads during purging. The printhead modules 34A-34D can include associated electronics for operation of the one or more printheads by the controller 80' although those connections are not shown to simplify the figure. Although the printer 10 includes four printhead modules 34A-34D, each of which has two arrays of printheads, alternative configurations include a different number of printhead modules or arrays within a module.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by controller 80' operating one or more actuators 40 to rotate the shaft 42 on which the take up roll 46 is placed to pull the web from the media roll 38 as it rotates about the shaft 36. When the web is completely printed, the take-up roll can be removed from the shaft 42 for additional processing. Alternatively, the printed web can be directed to other processing stations (not shown) that perform tasks such as cutting, collating, binding, and stapling the media. Alternatively, ink images can be printed on individual sheets of media rather than web W.

Operation and control of the various subsystems, components and functions of the machine or printer 10 are performed with the aid of a controller or electronic subsystem (ESS) 80'. The ESS or controller 80' is operably connected to the components of the ink delivery system 20', the purge system 24, the printhead modules 34A-34D (and thus the printheads), the actuators 40, and the heater 30. The ESS or controller 80', for example, is a self-contained, dedicated mini-computer having a central processor unit (CPU) with electronic data storage, and a display or user interface (UI) 50. The ESS or controller 80', for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80' is the main multi-tasking processor for operating and controlling all of the other machine subsystems and functions, including the printing process.

The controller 80' can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80' from either a scanning system or an online or work station connection for processing and generation of the printhead control signals output to the printhead modules 34A-34D. Additionally, the controller 80' determines and accepts related subsystem and component controls, for example, from operator inputs via the user interface 50, and accordingly executes such controls. As a result, inks for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 2:
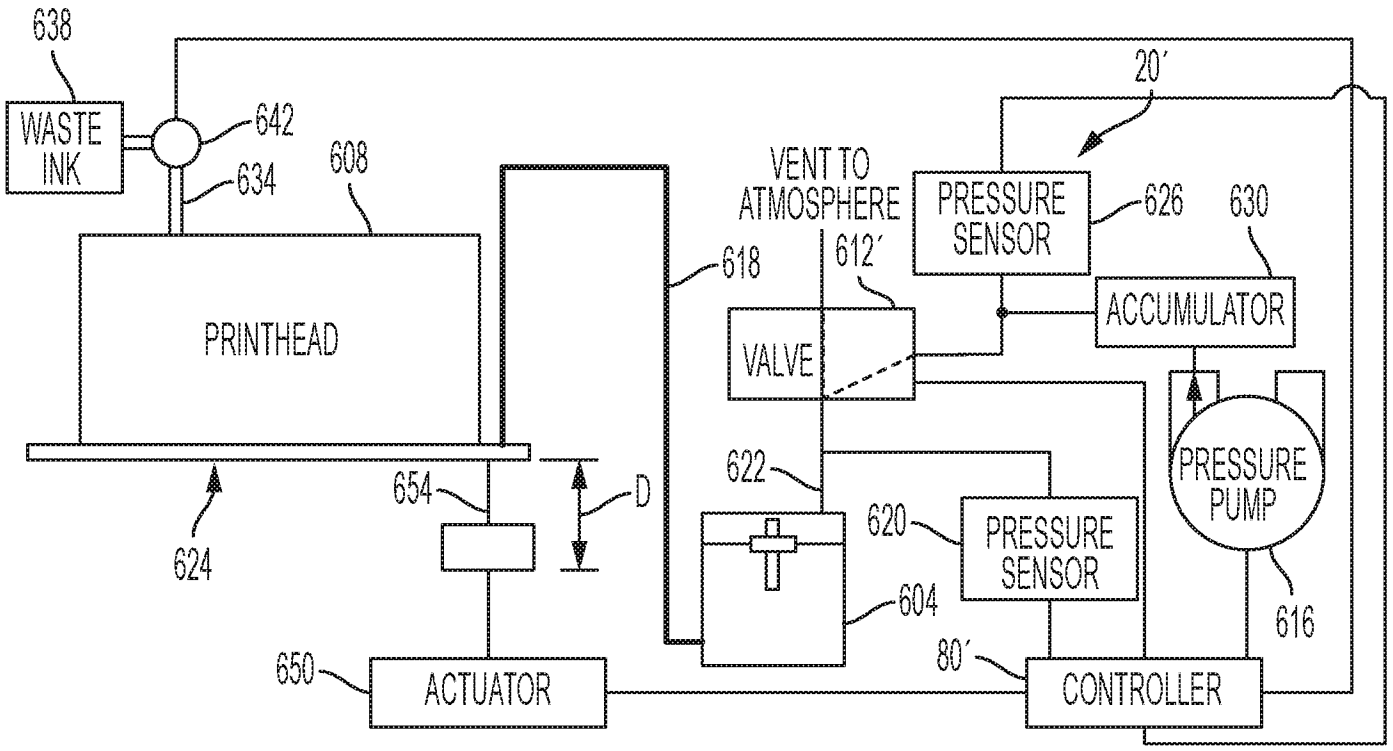
FIG. 2 is a schematic diagram of an ink delivery system that is used in the printer shown in FIG. 1 to purge the printheads with a short duration purge pressure.
Figure 3:
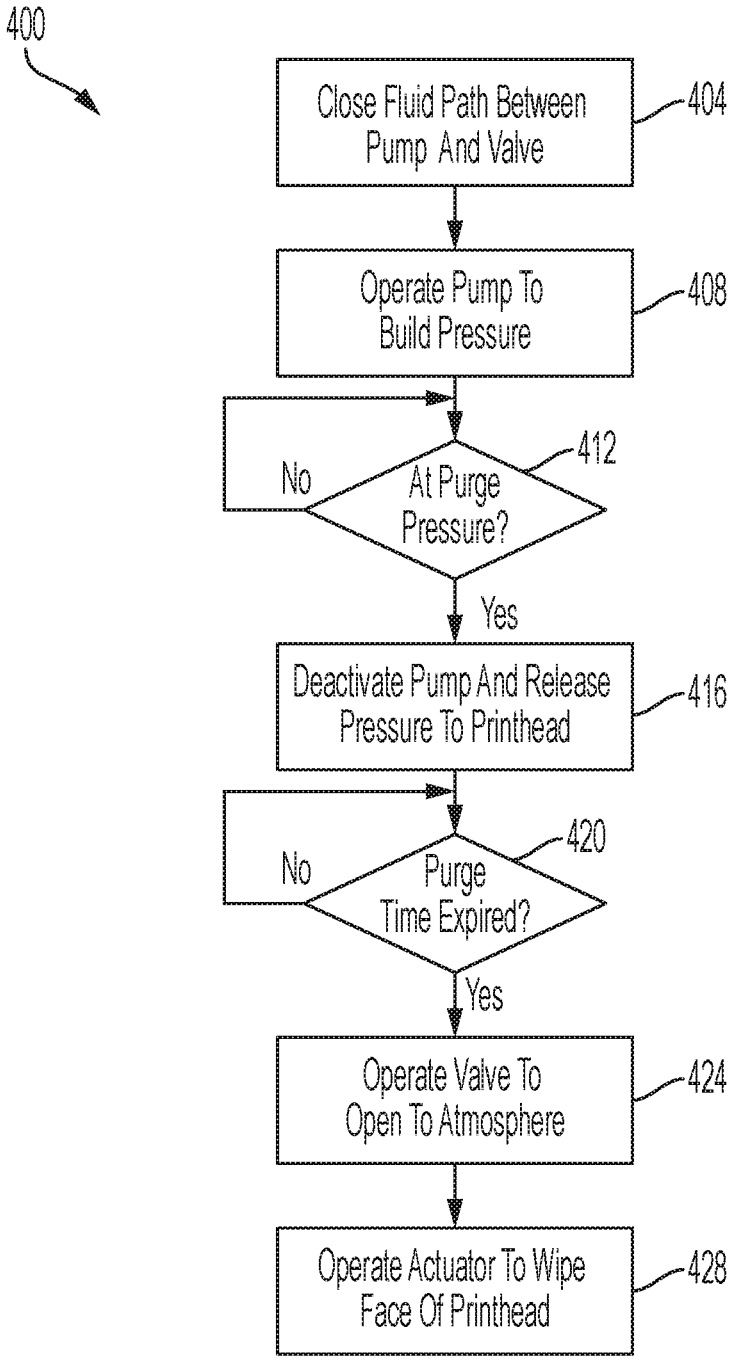
FIG. 3 is a flow diagram of a process for operating the ink delivery system of the printers of FIG. 1 and FIG. 2 to purge the printheads with a short duration purge pressure.
Figure 9:
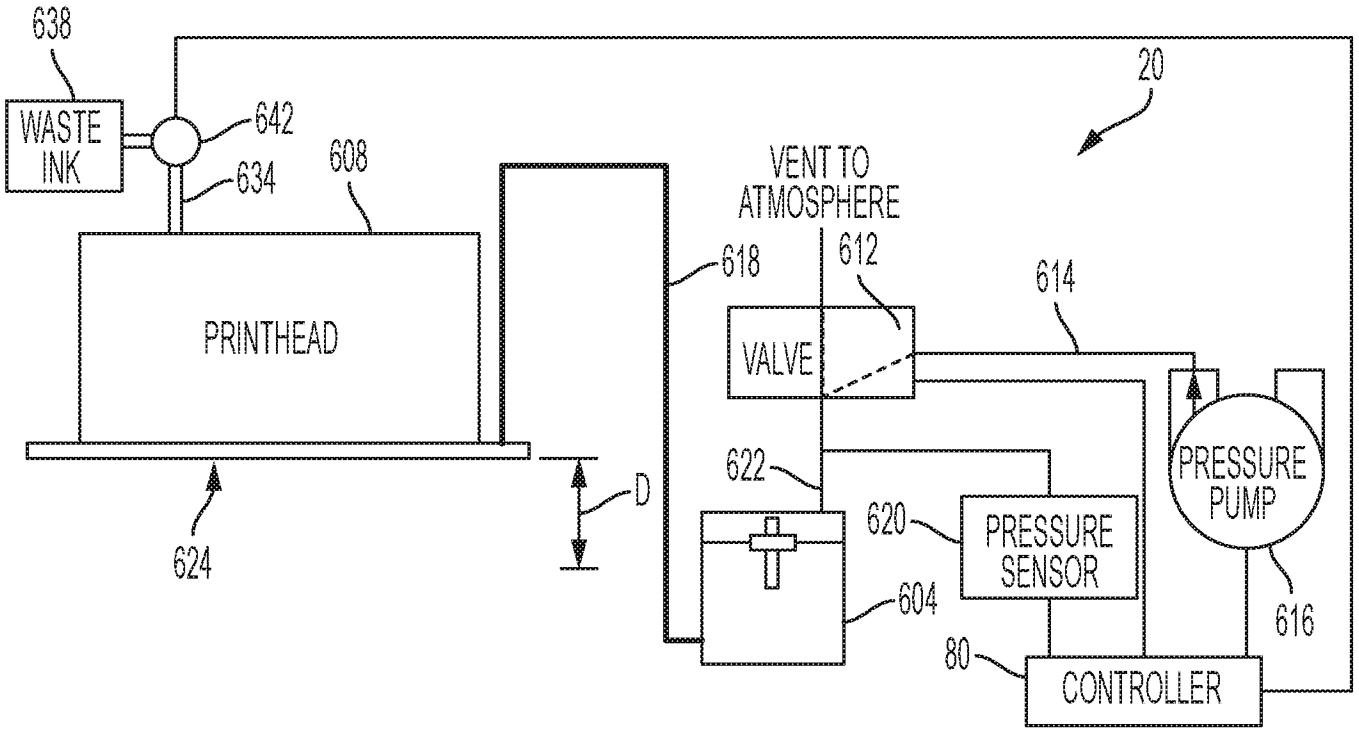
FIG. 9 PRIOR ART
FIG. 9 is a schematic diagram of a prior art ink delivery system that is used in prior art printers for purging.

Using like numbers for like components, an ink delivery system that can reduce the loss of inks from printheads during purging is shown in FIG. 2. This system 20' differs from the one shown in FIG. 9 in that controller 80' is configured to perform the process 400 shown in FIG. 3 during print jobs and between print jobs to purge the printheads supplied by the ink reservoir 604. FIG. 3 depicts a flow diagram for the process 400 that operates the ink delivery system 20' to purge the printhead 608 more quickly and bidirectionally wipe the faceplate to reduce the amount of ink lost during purging. In the discussion below, a reference to the process 400 performing a function or action refers to the operation of a controller, such as controller 80', to execute stored program instructions to perform the function or action in association with other components in the printer. The process 400 is described as being performed by an ink delivery system 20' in the printer 10 of FIG. 1 for illustrative purposes.

In the ink delivery system 20' and the purge system 24' of FIG. 2, the pressure sensor 620 is not required. Instead, a pressure sensor 626 is pneumatically coupled to the conduit 614 between the valve 612' and the pump 616. The valve 612' is different than the valve 612 since it is configured so the valve member can be moved to (1) a first position to open the ink reservoir to atmosphere, (2) to a second position to close the path between the pump 616 and the reservoir 604, and (3) to a third position to open the path between the pump 616 and the reservoir 604. Additionally, an accumulator 630 is provided between the purge valve 612' and the pump 616. This accumulator is used to store pressurized air when the valve member in valve 612' is either in the second or the third position so the pressurized air can be release for a purge cycle. The accumulator 630 has enough capacity to support multiple purges with each purge having a duration in a range of about 150 to about 250 milliseconds.

Figure 4:
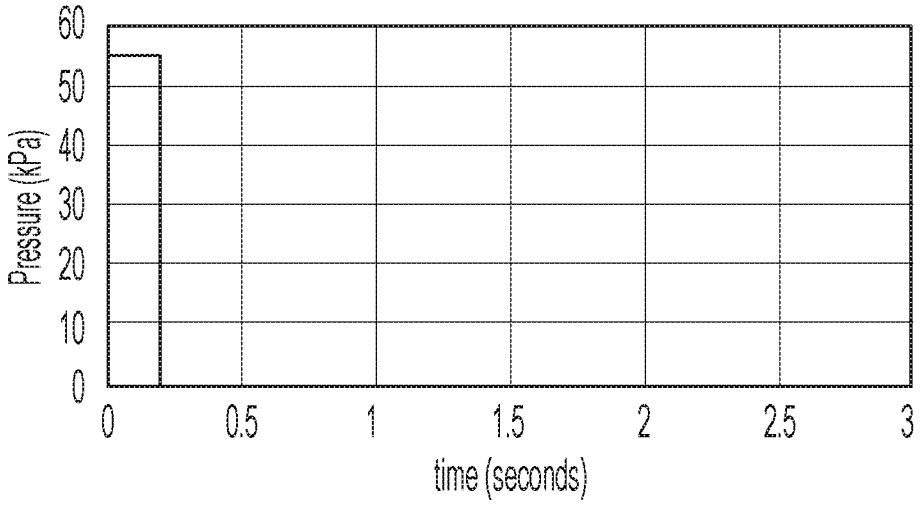
FIG. 4 is a graph of the short duration pressure pulse used in the process of FIG. 3.
Figure 10:
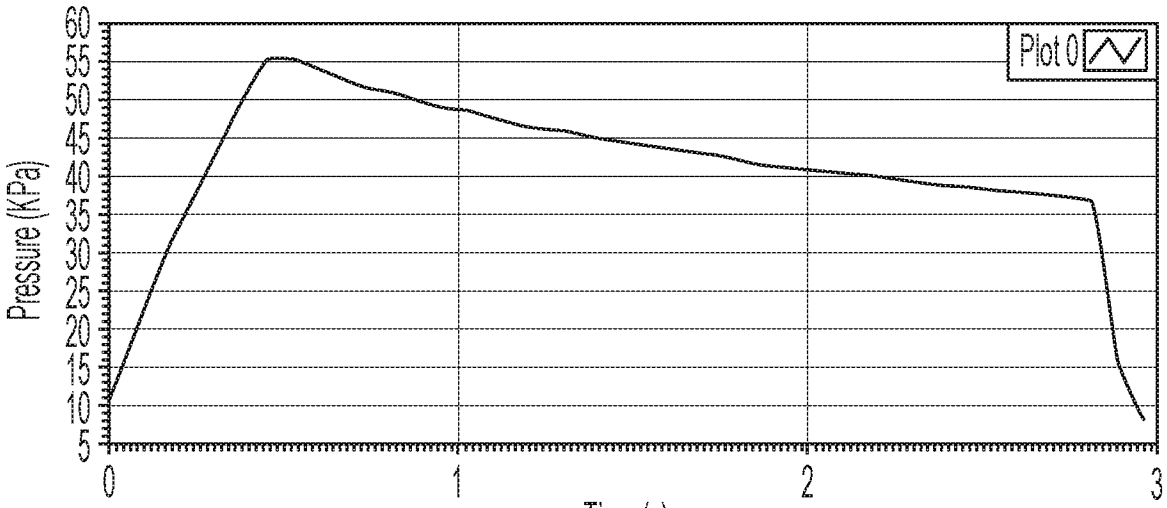
FIG. 10 PRIOR ART
FIG. 10 is a graph of the pressure pulse used in the prior art purging process.

During a purge cycle, the controller operates the valve 612' to move the valve member to the second position to close the conduit 614 between the reservoir 604 and the pump 616. The controller monitors the signal generated by the sensor 626 to determine when the pressure between the valve and the pump reaches a predetermined level. When the predetermined level is reached, the controller 80' operates the valve 612' to move the valve member to the third position to release the pressurized air from the accumulator 630 to the reservoir 604 and the printhead 608 to purge the printhead. The duration of the application of this pressure is limited to a predetermined purge time in a range of about 150 to about 250 milliseconds, which is substantially less than the previously known nominal times of pressure application for purges noted above. A graph of this pressure pulse is shown in FIG. 4. The areas under the curve for the pressure pulse shown in FIG. 10 and the curve for the pressure pulse shown in FIG. 4 represent the amount of ink emitted by the printhead reacting to the two pressure pulses. Comparing the two figures, one can see that the area under the curve shown in FIG. 4 is about five percent of the area under the curve shown in FIG. 10. Thus, ninety-five percent of the ink emitted by application of the pulse shown in FIG. 10 is saved when the pulse shown in FIG. 4 is used instead. After the predetermined time for the pulse of FIG. 4 expires, the controller 80' operates the valve 612' to move the valve member to the first position to open to ink reservoir to atmosphere pressure so the pressure applied to the printhead falls quickly while the pressure within the accumulator 630 remains stable. The reduced duration of the purge pressure on the printhead results in less ink seeping out of the printhead. The controller 80' then operates an actuator 650 that is operatively connected to a wiper 654 to move the wiper along the longitudinal axis of the faceplate in a first direction and then, after the wiper has passed the printhead 608, reverse the operation of the actuator 650 to move the wiper in the opposite direction across the faceplate until it passes the opposite end of the printhead. The movement of the wiper uses the expelled ink to clean the faceplate and to remove the expelled ink from the faceplate.

During printing operations, the ink delivery system 20' and the printhead 608 are fully primed, which means ink fills the conduit between the waste tank 638 and the manifold outlet of the printhead 608, the manifold and the inkjets of the printhead are full of ink, and the conduit 618 between the manifold inlet and the ink reservoir is full of ink. When the printheads of printer 10 are purged, the process 400 of FIG. 3 is performed. The process begins with the controller operating the valve 612' to close the path between the valve and the pump 616 (block 404). The process continues with the controller 80' operating the pump 616 to apply positive air pressure in the conduit 614 (block 408). The controller monitors the signal from the pressure sensor 624 until the pressure in the conduit 614 and the accumulator 630 reaches a predetermined threshold (block 412). The range of pressures for this predetermined threshold depends upon a number of factors, such as the diameter of the tubes connecting the ink reservoir and the printhead, the number of printheads connected to the ink reservoir, the size of the ink reservoir and the ink manifold in the printhead, and the number of inkjets in the printhead or printheads, for example. In one embodiment, this pressure is about 55 kPa. The controller 80' deactivates the pump 616 and operates the valve 624 to release the pressure to the printhead 608 through the ink reservoir 604 (block 416). The controller 80' waits for a predetermined time period (block 420) and then operates the valve 624 to connect the ink reservoir 604 to atmosphere again (block 424). The duration of the predetermined time period is considerably shorter than known nominal purge times to reduce the amount of ink that seeps from the printhead. In one embodiment, the predetermined time period is in a range of about 150 to about 250 milliseconds, but again the length of the time period depends upon the printhead configuration and related factors, for example. The pressure falls quickly once the valve 612' is opened to atmosphere pressure, as shown in the graph of FIG. 4. The controller 80' operates the actuators to wipe the faceplate of the printhead bidirectionally along a longitudinal axis of the faceplate with the wiper 654 (block 428). The purge is then complete and the printhead returns to operational status. Thus, this process reduces the amount of ink lost during purges but inkjet renewal is still preserved.

FIG. 2 shows one ink delivery system 20' configured to supply ink to a single printhead. In such embodiments, an ink delivery system can be provided for each printhead in the printer. In other embodiments, the ink delivery system 20' can be configured to supply multiple printheads with the same color ink. Thus, one ink delivery system can be configured to supply ink to all the printheads within one of the printhead modules 34A, 34B, 34C, and 34D or multiple ink delivery systems can be configured to supply ink to different printheads in a printhead module in a one-to-one correspondence. The ink delivery system and purge systems are operated from time to time during printing operations to restore inoperable inkjets in the printheads in a manner that preserves more ink for printing.

Figure 5:
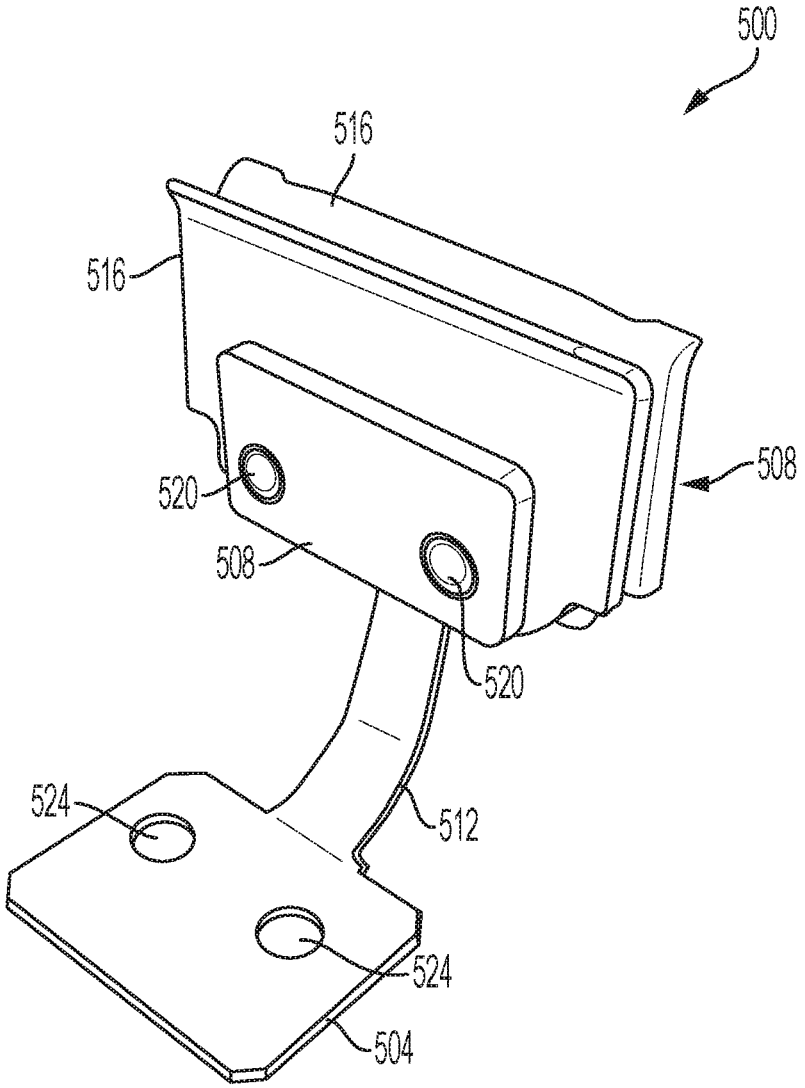
FIG. 5 is a wiper used to wipe the faceplate of a printhead after the purge cycle has been performed.

An improved wiper that is effective for wiping printhead faceplates with the reduced amount of ink that seeps from the printheads during the purging method described above is shown in FIG. 5. The wiper 500 includes a planar base member 504, a clamping member 508, and a spring arm 512 that connects the base member to the clamping member. A pair of wiper blades 516 are held between clamping member 508 and a separate clamping member positioned on the opposite side of the blades 516. As used in this document, the term "clamping member" means a planar component configured to hold a wiper blade in cooperation with another clamping member. One or more retaining members 520 pass through the clamping members 508 and the wiper blades 516 so the threaded ends of the retaining members 520 are received in threaded openings of clamping member 508. Thus, a lower portion of the wiper blades 516 are secured between the clamping members 508 while the beveled ends of the wiper blades 516 extend above the clamping members. The planar base member 504 is configured with one or more openings 524 so the base member can be mounted to a member operatively connected to the actuator 650 (FIG. 2) for movement of the wiper 500. The wiper blades 516, in one embodiment, are Mutoh blades available from Digiprint Supplies of Gosselies, Belgium as part #PWIMUVJ001. These blades are made of silicone so they are high quality solvent resistant wipers. Two of these blades are positioned back to back with a shim placed between them to provide a ~1/16" gap between them. As used in this document, the term "shim" refers to piece of material configured to be placed between two wiper blades to separate the blades within the clamping members from one another by a predetermined distance. This small gap allows ink to drain out between the blades while wiping a printhead faceplate after a purging operation. As used in this document, the term "spring arm" means a piece of spring steel having a thickness that enables the spring steel to flex easily with minimal pressure. In one embodiment, the spring arm 512 is approximately 0.018" thick. This flexing allows the wiper blades to operate at an optimal angle for wiping.

Figure 6B:
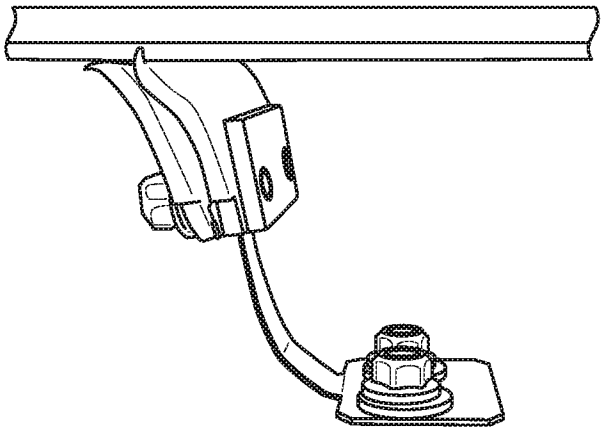
FIG. 6A is an illustration of the wiper of FIG. 5 moving in a first direction across a printhead faceplate and FIG. 6B is an illustration of the wiper of FIG. 5 moving in a direction opposite to the one shown in FIG. 6A.
Figure 6A:
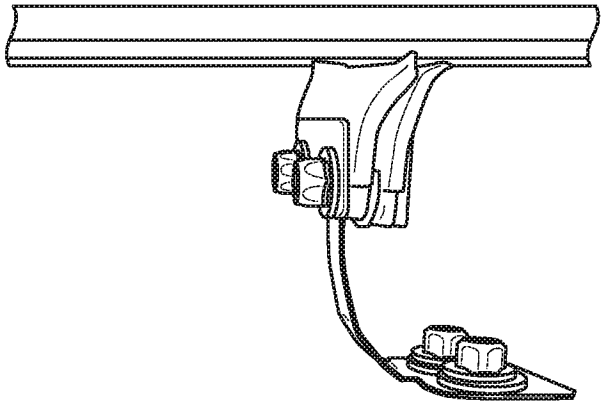

In one embodiment, the printheads traverse up and down while the member to which the wiper or wipers is attached traverses back and forth to wipe a printhead following a purge. When the blades 516 of the wiper 500 are placed in contact with the printhead faceplate and is moving, the blades spring-load themselves into the optimal wiping position as it traverses along the printhead faceplate. After the wiper passes the far end of the printhead, the blades spring-load themselves into the optimal position for the reverse movement of the member to which the wiper 500 is attached so the wiper returns to the original starting position. This movement is shown in FIG. 6A and FIG. 6B.

Figure 7A:
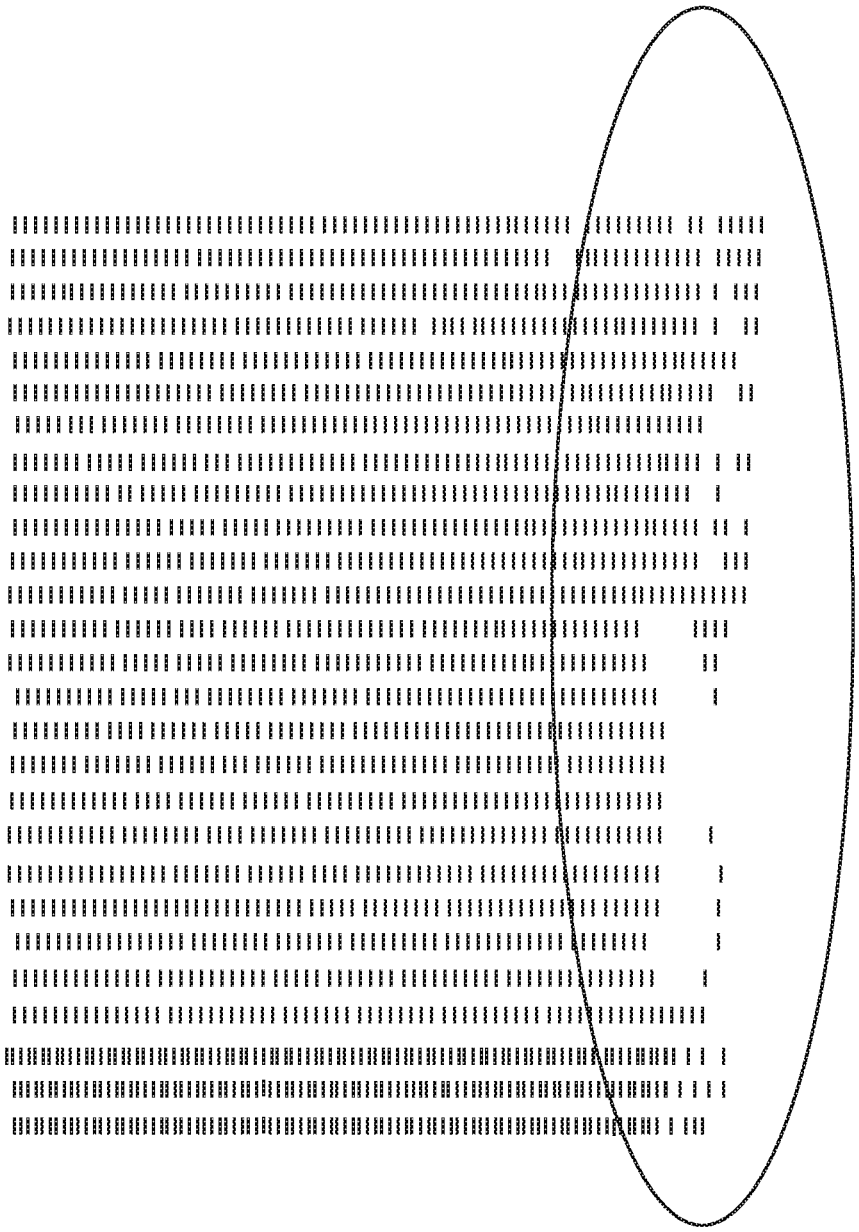
FIG. 7A illustrates the missing inkjets that arise from a single pass wiping operation and FIG. 7B illustrates the greater efficiency in restoring inkjets achieved with a bidirectional wiping operation.
Figure 7B:
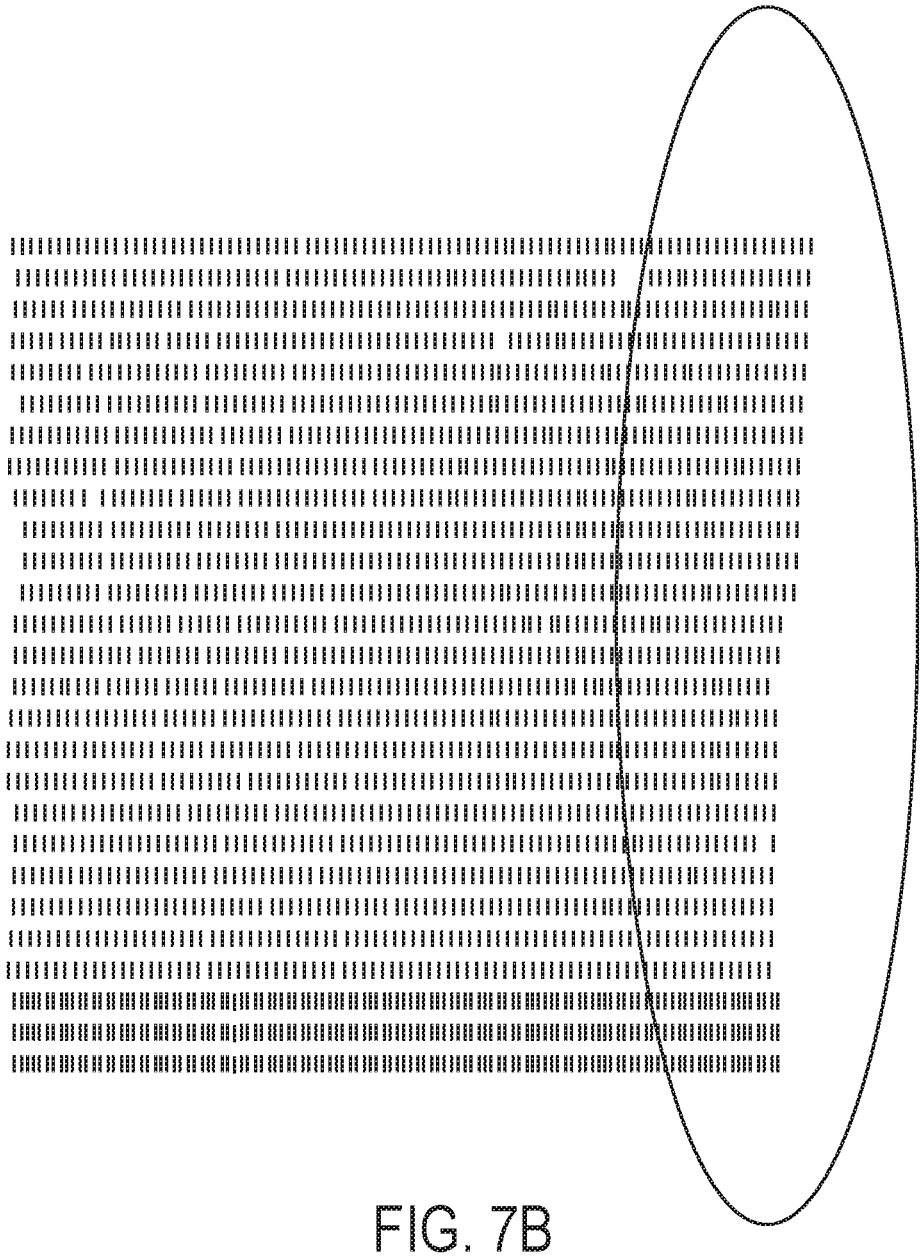

Single direction wiping is insufficient to restore inoperative inkjets with the reduced volume of ink that seeps out of the printhead using the short duration pressure pulse described above. This inability to restore inkjets is especially present at the inkjets first encountered by the blades 516 during a wipe. That is, insufficient ink pooling occurs at these inkjets but the reverse movement of the wiper does bring an adequate amount of ink over these inkjets to restore them at the end of the wiping movement. The encircled area in FIG. 7A shows evidence of inoperative inkjets resulting from a single pass wiper while the encircled area in FIG. 7B shows all of the inkjets have been restored by the bidirectional wiping.

Figure 8:
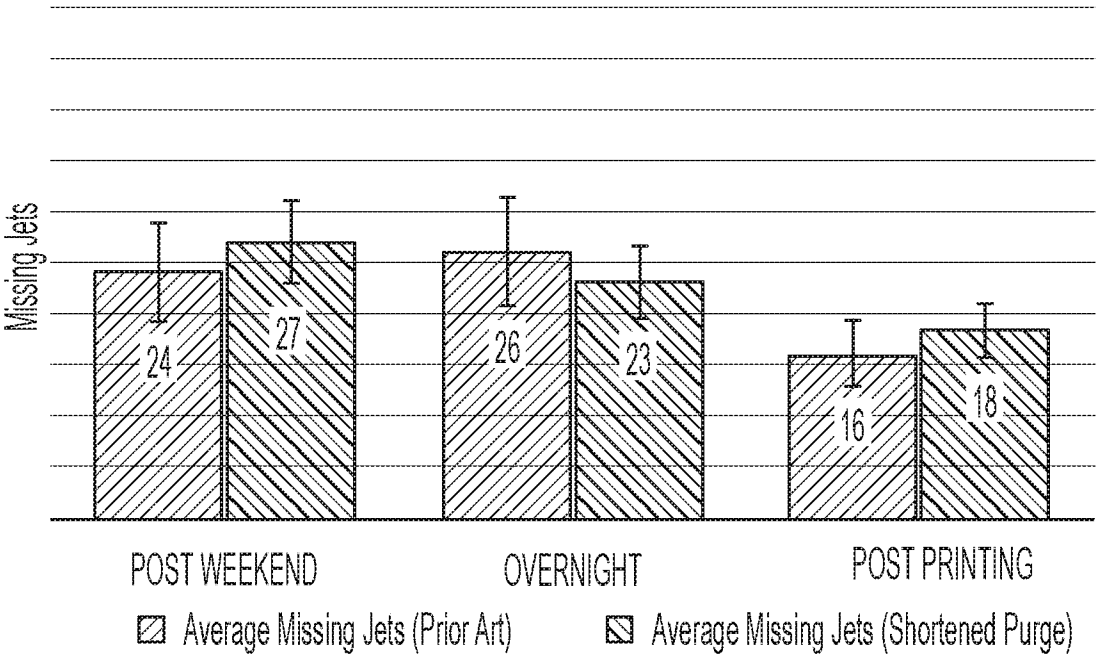
FIG. 8 is a graph comparing the efficiency of the prior art purging method to the purging method using the short duration purge pulse.

FIG. 8 compares the number of inoperative inkjets remaining in printheads of a printer after the purging and wiping cycle described above is done and after the previously known purging cycle is done following a dormant weekend period, a dormant overnight period, and following a print job. This graph shows that the new purging and wiping cycle has an efficiency very close to that of the previously known method with much less ink wasted in the purging procedure. Thus, the new method is able to restore inkjets as well as the previously known purging method with the loss of much less ink.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An ink delivery system in a printer comprising:

an inkjet printhead having a faceplate;

an ink reservoir operatively connected to the printhead to provide ink from the ink reservoir to the printhead;

a pump;

a conduit operatively connected between the ink reservoir and the pump;

a valve positioned in the conduit, the valve being configured to move to a first position where the conduit is vented to atmosphere pressure, to a second position where the pump builds pressure in the conduit between the valve and the pump, and a third position where the pressure between the valve and the pump is released to the ink reservoir and the printhead;

a pressure sensor operatively connected to the conduit between the valve and the pump, the pressure sensor being configured to generate a signal indicative of a pressure within the conduit;

an accumulator pneumatically connected to the conduit and the pump; and a controller operatively connected to the valve, the pressure sensor, and the pump, the controller being configured to move the valve to the second position and operate the pump to build pressure in the conduit, monitor the signal from the pressure sensor and determine when the pressure in the conduit and the accumulator reaches a predetermined threshold, move the valve to the third position to apply the pressure in the conduit and the accumulator to the ink reservoir and the printhead when the signal from the pressure sensor indicates the pressure within the conduit and the accumulator reaches the predetermined threshold, and to move the valve to the first position after a predetermined time in a range of about 150 milliseconds to about 250 milliseconds has expired since moving the valve to the third position to vent the ink reservoir to atmosphere pressure.

2. The ink delivery system of claim 1 wherein the accumulator is sized to hold an amount of pressurized air corresponding to a plurality of pressure releases, each pressure release having a duration in the range about 150 milliseconds to about 250 milliseconds.

3. The ink delivery system of claim 2 further comprising:

a wiper;

an actuator operatively connected to the wiper; and the controller is operatively connected to the actuator, the controller being further configured to operate the actuator to move the wiper across a longitudinal axis of the faceplate bidirectionally.

4. The ink delivery system of claim 3 wherein the predetermined threshold is at least 55 kPA.

5. The ink delivery system of claim 4, the wiper further comprising:

a pair of clamping members;

a pair of wiper blades held between the clamping members.

6. The ink delivery system of claim 5 further comprising:

a shim positioned between the wiper blades within the pair of clamping members to provide a gap between the pair of wiper blades.

7. The ink delivery system of claim 6 wherein the shim is configured to provide a gap of about 1/16 of an inch between the wipers within the clamping members.

8. The ink delivery system of claim 6, the wiper further comprising:

a base planar member; and a spring arm that extends from the base planar member to at least one of the clamping members.

9. The ink delivery system of claim 8 wherein the wiper is positioned so the spring arm biases the wiper blades against the faceplate of the printhead when the wiper blades move bidirectionally across the longitudinal axis of the faceplate.

10. The ink delivery system of claim 9 wherein the wiper blades are made of silicone.

11. A method of operating an ink delivery system and a purging system in a printer comprising:

operating a valve with a controller to close a conduit between the valve and a pump;

operating the pump with the controller to build a pressure in the conduit;

monitoring with the controller a signal from a pressure sensor operatively connected to the conduit between the valve and the pump and an accumulator pneumatically connected to the conduit and the pump;

determining with the controller when the pressure in the conduit and the accumulator reaches a predetermined threshold;

operating the valve with the controller to apply the pressure in the conduit and the accumulator to an ink reservoir and a printhead when the signal from the pressure sensor indicates the pressure within the conduit and the accumulator reaches the predetermined threshold; and operating the valve with the controller after a predetermined time in a range of about 150 milliseconds to about 250 milliseconds has expired since the pressure was applied to vent the ink reservoir to atmosphere pressure.

12. The method of claim 11 further comprising:

operating the valve with the controller to apply the pressure in the conduit and the accumulator to the ink reservoir and the printhead multiple periods of time that are in the range of about 150 milliseconds to about 250 milliseconds.

13. The method of claim 12 further comprising:

operating with the controller an actuator operatively connected to a pair of wipers clamped between a pair of clamping members to move the pair of wipers across a longitudinal axis of a faceplate on the printhead bidirectionally.

14. The method of claim 13 further comprising:

biasing the pair of wiper blades against the faceplate of the printhead with a spring member when the wiper blades move bidirectionally across the longitudinal axis of the faceplate.

15. The method of claim 14 further comprising:

providing a gap between the wiper blades in the pair of wiper blades with a shim.

16. The method of claim 15 wherein the predetermined threshold is at least 55 kPA.

* * * * *